US005161613A

United States Patent [19]

Jones

[11] Patent Number: 5,161,613

[45] Date of Patent: Nov. 10, 1992

[54] APPARATUS FOR TREATING FORMATIONS USING ALTERNATE FLOWPATHS

[75] Inventor: Lloyd G. Jones, Dallas, Tex.

[73] Assignee: Mobil Oil Corporation, Fairfax, Va.

[21] Appl. No.: 745,658

[22] Filed: Aug. 16, 1991

[51] Int. Cl.[5] ..... E21B 43/25; E21B 43/27; E21B 33/138

[52] U.S. Cl. ..... 166/242; 166/67; 166/307; 166/285; 166/313

[58] Field of Search ..... 166/269, 97.5, 295, 166/308, 307, 300, 313, 281, 282, 283, 242, 305.1, 67, 177

[56] References Cited

U.S. PATENT DOCUMENTS 3,251,413 5/1966 Rudisell ..... 166/269
3,730,273 5/1973 Wilson ..... 166/269
3,991,827 11/1976 Schall ..... 166/295 X
4,424,859 1/1984 Sims et al. ..... 166/67
4,711,304 12/1987 Boeke et al. ..... 166/269 X
4,842,068 6/1989 Vercaemer et al. ..... 166/269
4,945,991 8/1990 Jones ..... 166/278
5,018,578 5/1991 Rabaa ..... 166/269 X

*Primary Examiner*—Stephen J. Novosad
*Attorney, Agent, or Firm*—Alexander J. McKillop; Charles J. Speciale; George W. Hager, Jr.

[57] ABSTRACT

A method and apparatus for treating multiple strata in a single operation from a single wellbore which penetrates a treatment interval which, in turn, includes a plurality of strata which, in turn, have different permeabilities. A treating fluid (e.g. consolidating agent, acid, etc.) is delivered directly to different levels within a section of the wellbore adjacent the interval to be treated through a plurality of alternate paths which, in turn, lie substantially adjacent to the strata to be treated.

2 Claims, 3 Drawing Sheets

APPARATUS FOR TREATING FORMATIONS USING ALTERNATE FLOWPATHS

DESCRIPTION

1. Technical Field

The present invention relates to treating a subterranean formation and in one aspect relates to a method and apparatus for treating (e.g. consolidating, acidizing, etc.) multiple strata or levels within a formation interval in a single operation from a single wellbore wherein the strata have different permeabilities.

2. Background Art

In producing hydrocarbons or the like from a well, it is not uncommon to treat the hydrocarbon-bearing formations to improve production and/or to extend the operational life thereof. For example, many producing reservoirs lie in unconsolidated and/or fractured formations which routinely produce large volumes of particulate material (e.g. sand) along with the desired fluids. If such formations are not treated, the continued production of particulates will generally create a variety of problems which result in added expense and considerable downtime of the well. That is, the production of particulates may cause (1) severe erosion of the well tubing and other production equipment; (2) partial or complete clogging or the flow from the well which requires workover of the well; (3) caving in the formation and collapse of the well casing; and (4) extra cost in processing the production fluids at the surface and disposal of the produced particulates. Accordingly, it is common to use sand control techniques to treat such formations to control this production of particulates.

One well known well treatment method used for sand control is generally referred to as "consolidating" the formation. In a typical sand consolidating method, a consolidating agent (e.g. thermosetting resin) is flowed down the wellbore under pressure and into the formation. The resin normally penetrates several inches into the formation where it occupies the pore spaces and envelopes the sand grains in the formation adjacent the wellbore. The formation temperature causes the consolidating agent to set and harden. As the resin hardens, it coats and cements the sand grains together but it also shrinks to about one-half to one-third of its original liquid volume thereby leaving open pore space, i.e. permeability, in the formation to allow production of formation fluids therethrough.

Other reservoirs lie in formations which are comprised primarily of limestone or other carbonate materials which adversely affect the permeability of the formation. In these types of reservoirs, it is common to "acidize" the formation wherein an acid, e.g. hydrochloric acid, is injected down the wellbore and into the formation to dissolve at least part of the carbonate material to thereby increase the permeability and stimulate production.

In a typical well treatment method such as described above, the section of the wellbore which lies adjacent the formation interval to be treated is isolated with packers or the like and a tubing string is lowered into the isolated section. The treating fluid is flowed out of the lower end of the tubing and into the isolated wellbore section from which it is forced under pressure into the formation being treated. Unfortunately, many hydrocarbon-bearing reservoirs (i.e. producing interval) are composed of several different strata or zones of production which have varying permeabilities. The more permeable strata yield their formation fluids easily while the less permeable strata produce more slowly, if at all. When the full thickness of such a reservoir is subjected to treatment (e.g. sand consolidation, acidizing, etc.) in a single operation, the treating fluid tends to take the path of least resistance and enters the more permeable strata or zone with little or no fluid entering the less permeable zones. When the well is returned to production, the untreated zones within the formation interval normally fail thereby allowing sand production where the well treatment is for sand control or continued decreased production where the well treatment is an acid treatment.

In known prior art treating methods of this type, the varying permeabilities of the statra have required that zones within the reservoir or formation interval be isolated or sealed off so that a particular zone can be treated individually. A tubing string is lowered to a point adjacent the isolated zone and the treating fluid is flowed from the lower end thereof to be delivered into the wellbore adjacent the isolated zone; usually the least permeable zone first. After the first zone is treated, a different zone is isolated and the procedure is repeated until all of the desired zones within the production interval are treated. It can be seen that such treatments can not be carried out in a single operation and are time-consuming and are generally very expensive to carry out.

SUMMARY OF THE INVENTION

The present invention provides a method for treating multiple strata in a single operation from a single wellbore which penetrates a treatment interval which, in turn, includes a plurality of strata which have different permeabilities. A section of the wellbore which lies adjacent the treatment interval is isolated and treating fluid (e.g. sand consolidating agent, acid, etc.) is delivered through a plurality of alternate paths directly to the different levels within the isolated section which respectively lie substantially adjacent to the strata to be treated.

More specifically, if the method is to be carried out in a cased wellbore, the casing is perforated at different levels to provide a plurality of perforations substantially adjacent the different strata in the treatment interval. The section of the cased wellbore lying substantially adjacent the treatment interval is isolated and fluid communication between the surface and the isolated section is provided through a well treating apparatus. The treating apparatus comprises a workstring having a means for providing alternate flowpaths into the isolated section for delivering treating fluid from the workstring directly to the different levels within the isolated section of the wellbore. A treating fluid is flowed down the workstring and out the alternate flowpaths to thereby treat the different strata of the treatment interval.

The well treating apparatus of the present invention has several embodiments. One embodiment is comprised of a workstring having a conduit which, in turn, has openings near its lower end which are spaced to coincide substantially to the different strata to be treated. Another embodiment is comprised of a plurality of conduits of different lengths which are adapted to terminate at different levels within the isolated section of the wellbore. These conduits may be encased within a carrier tube having a lower perforated section, may be carried on a central support tube, or may be fluidly connected to the bottom of a main fluid conduit.

In still another embodiment, the treating apparatus includes a workstring which is comprised of a conduit having a perforated section near its lower end which, in turn, is adapted to lie substantially adjacent the treatment interval when the apparatus is in an operable position within the wellbore. A plurality of shunt tubes of different lengths are mounted within the perforated section with their upper ends lying substantially adjacent the upper end of the perforated section and their lower ends terminating at different levels with the perforated section.

BRIEF DESCRIPTION OF THE DRAWINGS

The actual construction, operation and apparent advantages of the present invention will be better understood by referring to the drawings in which like numerals identify like parts and in which.

BEST KNOWN MODE FOR CARRYING OUT THE INVENTION

Figure 1:
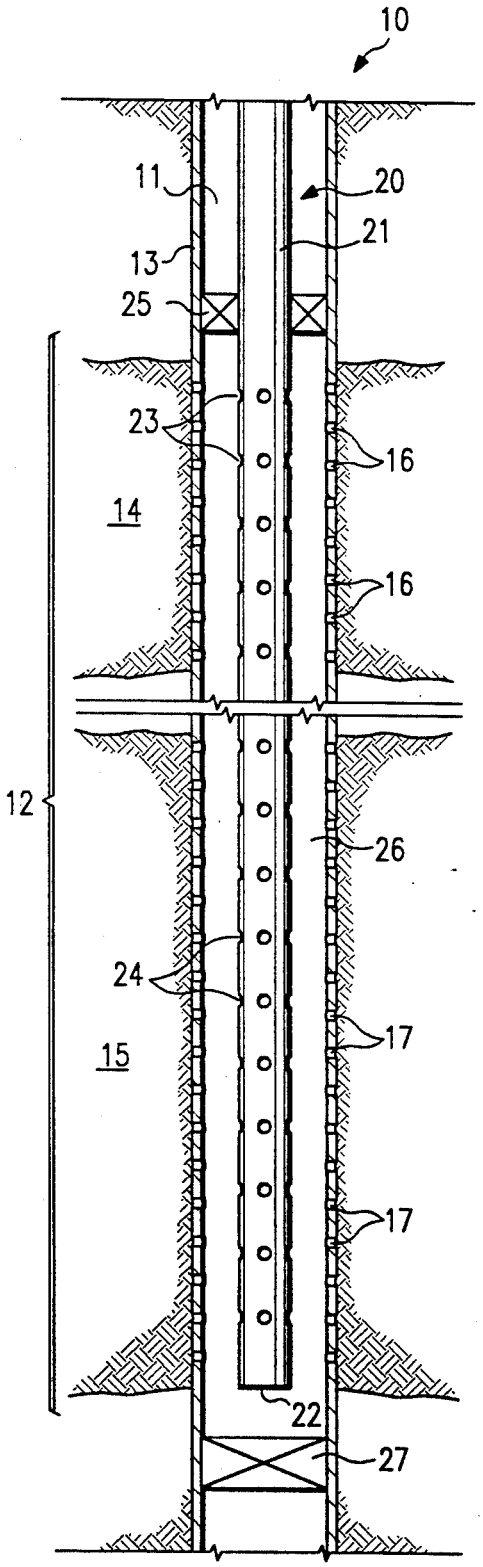
FIG. 1 is an elevational view, partly in section, of a well treating apparatus having alternate flowpaths in accordance with the present invention positioned in an operable position within a wellbore adjacent a formation to be treated.

Referring more particularly to the drawings, FIG. 1 illustrates the lower end of a producing and/or injection well 10. Well 10 has a wellbore 11 which extends from the surface (not shown) through treatment interval 12. Wellbore 11 is typically cased with a casing 13 which, in turn, is cemented (not shown) in place. While the present invention is illustrated in relation to a vertical, cased wellbore, it should be recognized that the present invention can equally be used in open-hole and/or underreammed completions as well as in inclined and horizontal wellbores, as the situation dictates.

As illustrated, treatment interval 12 is comprised of a plurality (only two shown) of zones 14, 15 which have different permeabilities. Casing 13 is perforated at different levels to provide at least two sets of perforations 16, 17 which lie substantially adjacent zones 14, 15, respectively. Since the present invention is appliable in horizontal and inclined wellbores, the terms "upper and lower", "top and bottom", as used herein are relative terms and are intended to apply to the respective positions within a particular wellbore while the term "zones" is meant to refer to respective positions lying along the wellbore between the terminals of the treatment interval.

Well treating apparatus 20 of the present invention is positioned in wellbore 11 substantially adjacent treatment interval 12. Well treating apparatus 20 is comprised of a tubing or workstring 21 which is closed at its lower end 22 and which extends to the surface (not shown). Tubing string 21 has a plurality of openings (e.g. upper and lower sets of openings 23, 24, respectively) which are spaced above the lower end 22 to coincide roughly with casing perforations 16, 17, respectively. Appropriate packers 25 and 27 or other means, e.g. columns of liquid in the well annulus, "isolate" the section 26 of wellbore 11 which lies adjacent treatment interval 12. As used herein, the term "isolated section" refers to the section of the wellbore which lies adjacent the interval to be treated.

In operation, a treating fluid, e.g. consolidating agent (resin, sodium silicate, or the like) or acid (hydrochloric, etc.) is pumped down workstring 21 and out through upper and lower openings 23, 24 into the isolated section 26 of wellbore 11. As section 26 fills with treating fluid and the pressure increases, the treating fluid is forced through casing perforations 16, 17 and contacts zones 14, 15 of the treatment interval 12. However, since, as illustrated, zone 15 has a higher permeability, the treating fluid takes the path of least resistance and substantially all of the fluid will flow into zone 15.

In a conventional well treating operation where the treating fluid only exits through the lower end of a workstring, the treating fluid will continue to flow into zone 15 with little or no fluid being forced through the upper casing perforations 16 into zone 14. This uneven distribution of treating fluid over the treatment interval results in little or no treatment of the less permeable zones in the treatment interval. This, in turn, results in the other zones having to be individually isolated, the workstring having to be repositioned within these zones, and treatment fluid having to be flowed separately to each of these zones in order to adequately treat the entire treatment interval 12.

In the present invention, even while the treating fluid is flowing into the more permeable zone 15, treating fluid will also continue to flow through upper openings 23 (i.e. alternate flowpaths) in the tubing string 21 to be delivered directly adjacent the less permeable zones to thereby treat the lesser permeable zone 14 through casing perforations 16. While only two zones in the treatment interval and two sets of openings in both the workstring and casing have been illustrated, it should be understood that the workstring and casing may have openings at more than two levels to service more than two zones in the desired treatment interval. The important feature is to provide alternate flow paths for the treating fluid to the different levels or zones of the treatment interval so all of the zones can be treated in a single operation from a single tubing string. That is, the treating fluid will continue to be delivered to the respective levels in the interval to treat the respective zones until all of the zones have been treated regardless of the permeabilities of the respective zones.

While in most operations the treating fluid will flow simultaneously through all of the alternate flowpaths to all of the different levels within the treatment interval, there may be times that it will be desired to treat the strata of a particular treatment interval in a preferred sequence. Accordingly, the respective openings in the workstring can be sized so that the treating fluid will seek the path of least resistance and substantially flow primarily through larger openings in the workstring which are positioned adjacent the first strata to be treated. After the first strata has been substantially treated, the pressure builds up adjacent the larger opening wherein the bulk of the fluid will then flow through a second set of smaller openings positioned adjacent a second strata, and so forth until all of the strata have been treated. Also, valve means (not shown), e.g. discs which rupture at different pressures, may be used to close selected openings in the workstring at particular levels so that no flow will occur through these openings until a desired pressure is reached within the workstring.

Figure 2:
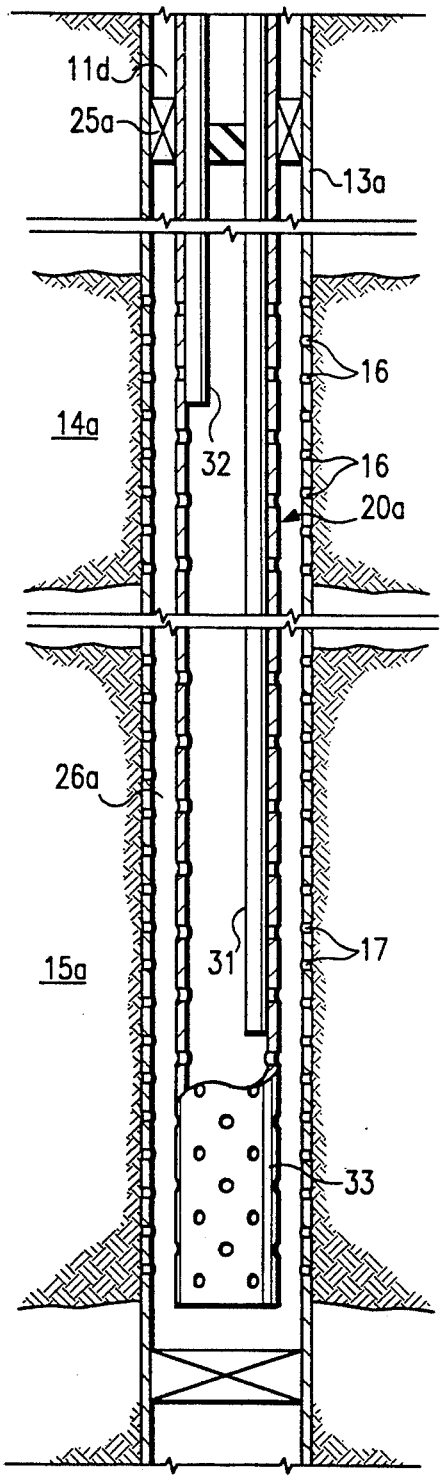
FIG. 2 is an elevational view, partly in section, of an embodiment of the present well treating apparatus having different alternate flowpaths in accordance with present invention.

FIGS. 2 illustrates another embodiment of the present well treating apparatus. Treating apparatus 20*a* is comprised of a bundle or plurality of conduits 31, 32 (only two shown) which are mounted and encased within perforated carrier tube 33 which, in turn, provides structural integrity and support for the conduits. Conduits 31, 32 may be of different lengths (as shown) so that they terminate at different levels within tube 33 and open only at their lower ends or they may be of equal or varying lengths with openings (not shown) at different levels to coincide substantially with the different perforations in casing 13*a*.

As seen in FIG. 2, treating fluid is delivered out the lower ends of the individual conduits 31, 32 to fill the lower end of carrier tube 33. The fluid flows out of the perforations in tube 33 and fills isolated section 26*a* of the wellbore. As described above, the fluid initially enters the more permeable zone 15*a*. When this occurs, the treating fluid continues to be delivered through conduit 32 to treat the second zone in the treatment interval.

Figure 3:
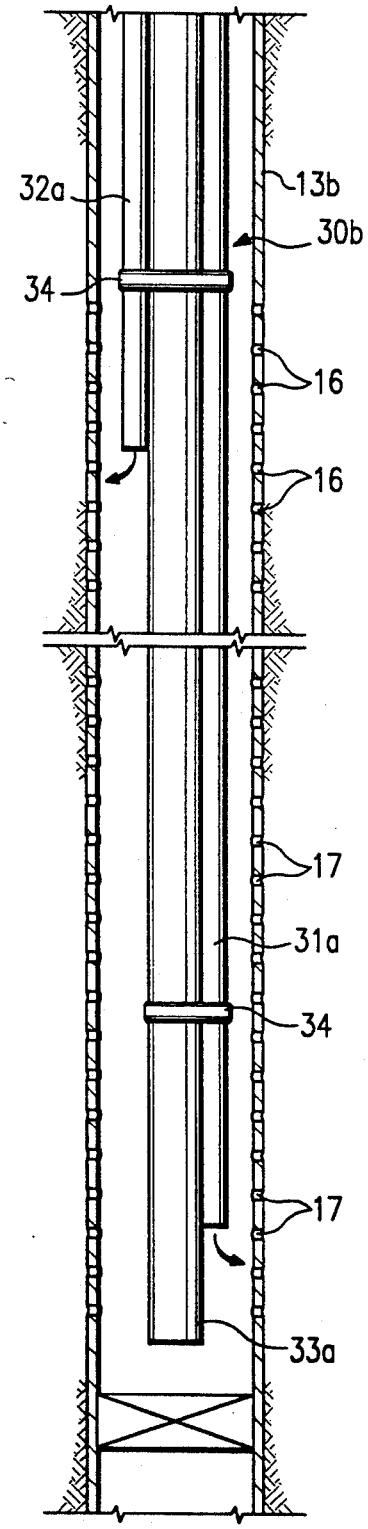
FIG. 3 is an elevational view, partly in section, of a further embodiment of the present well treating apparatus.

FIG. 3 illustrated a well treating apparatus 30*b* having a plurality of conduits 31*a*, 32*a* which are mounted on and carried by a central tubular member 33*a*. Bands 34 or the like secure the conduits onto the outer surface of central member 33. The conduits 31*a*, 32*a* terminate at different levels and are used to carry out the well treatment operation in the same manner as described above in relation to the well treating apparatus 20*a*.

Figure 4:
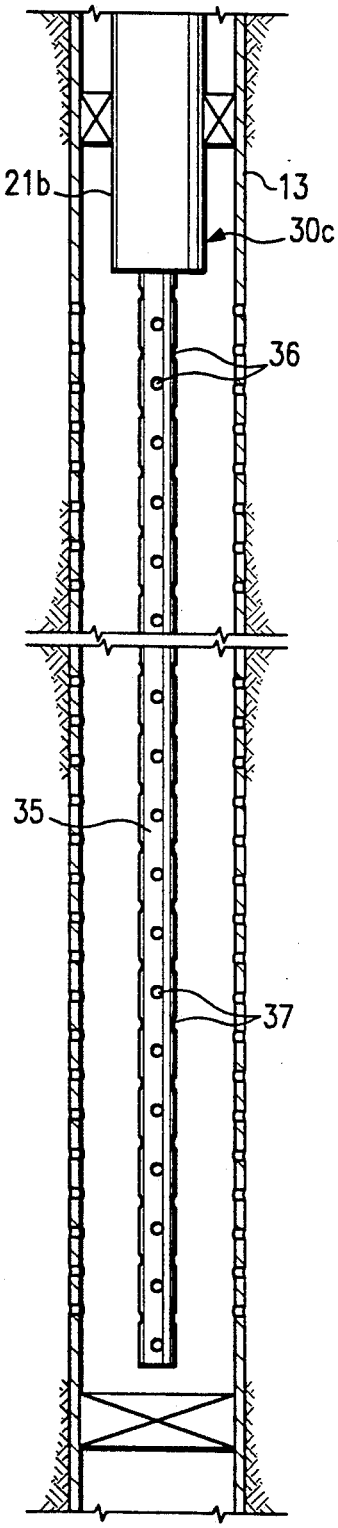
FIG. 4 is an elevational view, partly in section, of still another embodiment of the well present treating apparatus.
Figure 5:
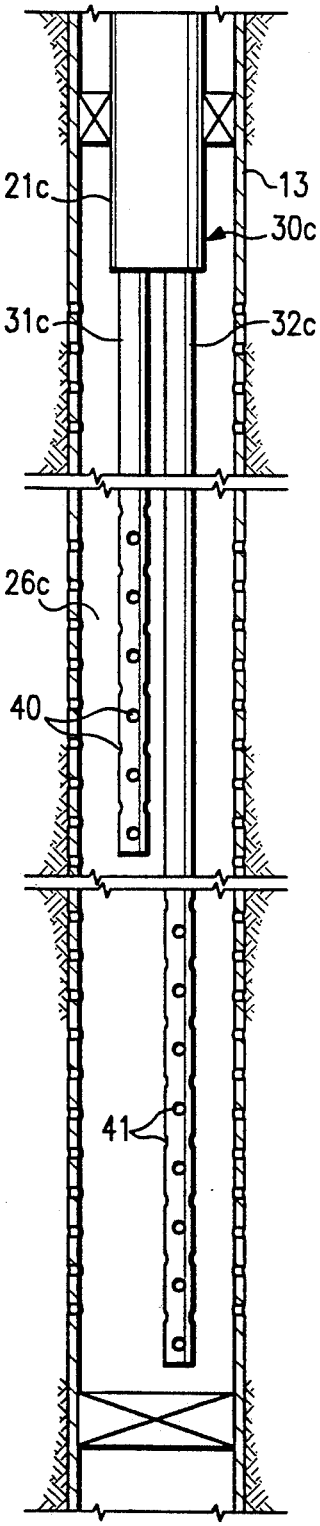
FIG. 5 is an elevational view, partly in section, of a still further embodiment of the present well treating apparatus.

FIGS. 4 and 5 illustrate further embodiments of the present invention wherein well treating apparatus 30*c* is comprised of a workstring 21*b*, 21*c*, respectively, which is adapted to extend downward into the wellbore to a point which is substantially adjacent the top of the treatment interval (not shown). In FIG. 4, a single, reduced diameter conduit 35 is connected to the bottom of workstring 21*b* and includes openings 36, 37 (alternate flowpaths) which are spaced to lie adjacent the zones to be treated when the apparatus 30*c* is in an operable position within the well. In FIG. 5, a plurality of conduits 31*c*, 32*c* (only two shown) having different lengths are connected to the bottom of workstring 21*c* and are in fluid communication therewith. When apparatus 30*c* is in an operable position within the wellbore, conduits 31*c*, 32*c* terminate at different levels within the wellbore adjacent different zones of the treatment interval. Each of the conduits are perforated along their respective lower ends to provide a plurality of openings 40, 41, respectively. Treating fluid flows down tubing string 21*c* and is delivered directly to different levels within the isolated section 26*c* through the openings in the conduits (i.e. alternate paths) to carry out the treating operation as described above.

Figure 6:
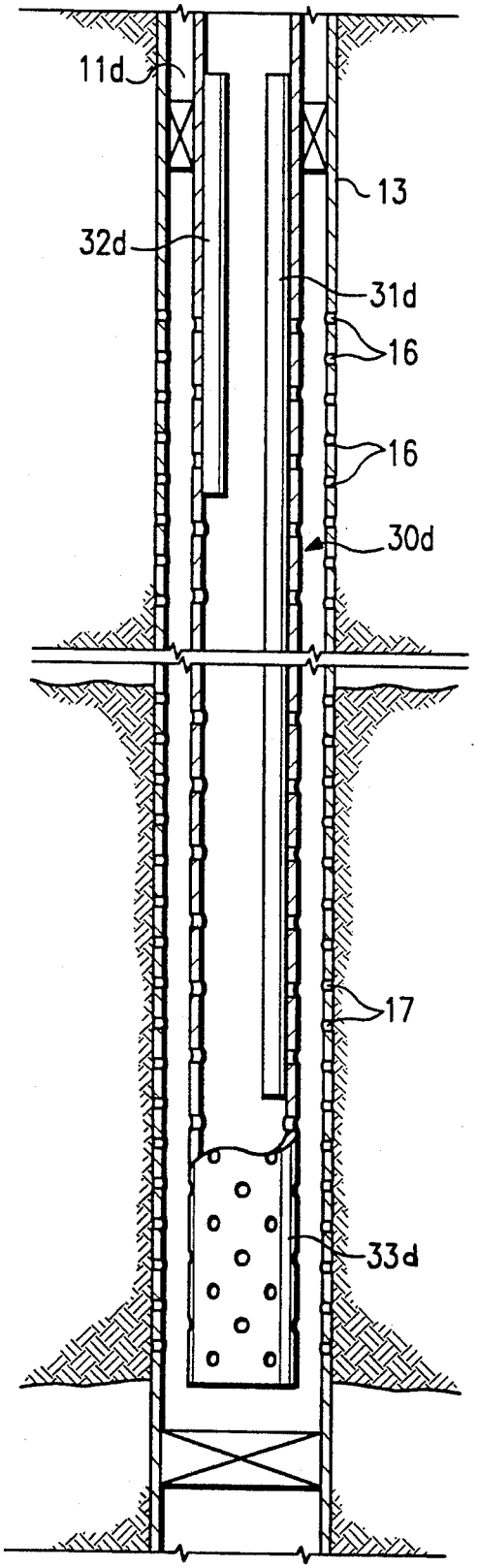
FIG. 6 is an elevational view, partly in section, of an embodiment of the present well treating apparatus having shunt tubes as alternate flowpaths.

Still another embodiment of the present invention is shown in FIG. 6 wherein the well treating apparatus 30*d* is comprised of a carrier tube 33*d* having a perforated lower section which is adapted to lie substantially adjacent to treatment interval when apparatus 30*d* is in an operable position within wellbore 11*d*. A plurality of shunt tubes 31*d*, 32*d* (only two shown) of different lengths are mounted within the perforated section of the workstring with their upper ends lying substantially adjacent the upper end of the perforated section and their respective lower ends terminating at different levels within the perforated section. The shunts tubes are open at both their upper and lower ends to allow fluid flow therethrough.

In operation, treating fluid flows down the workstring and out the perforated section at the lower end thereof. At the same time, treating fluid is flowing through the shunts tubes (i.e. alternate paths) and the adjacent openings in the perforated section to be delivered directly to the respective different levels. Even as the treating fluid is flowing into the more permeable zones, treating fluid is also flowing through the other shunt tubes to treat the other zones within the treatment interval.

Figure 7:
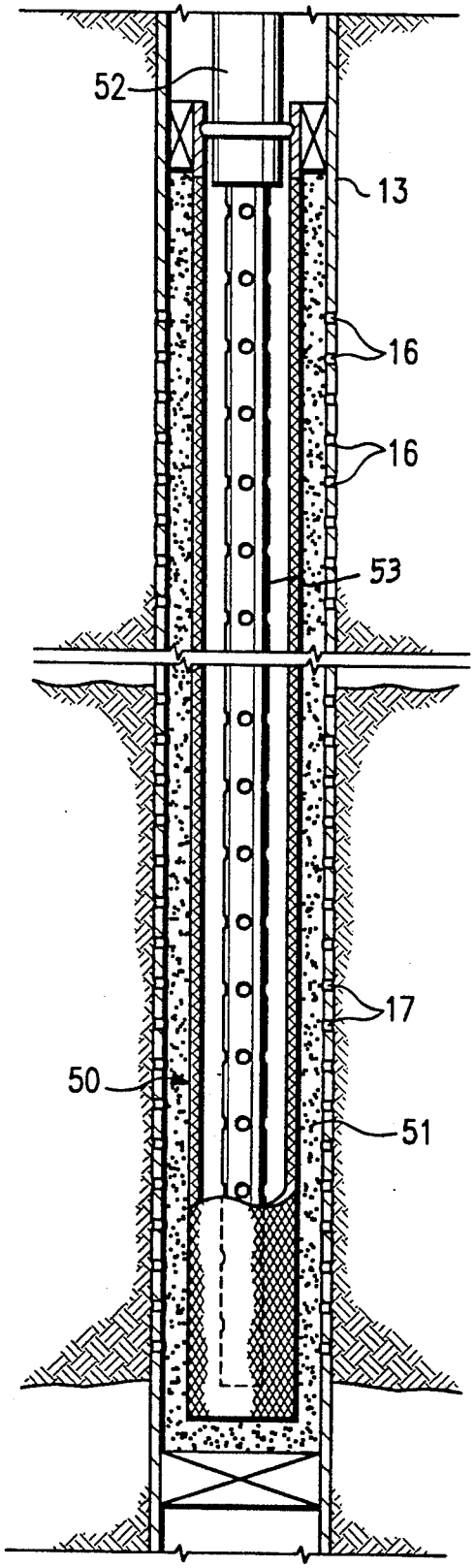
FIG. 7 is an elevational view, partly in section, of an embodiment of the present invention wherein the well treatment method is carried out within a previously gravel-packed interval of the wellbore.

FIG. 7 discloses the present invention as carried out in a previously gravel-packed section of the wellbore. A screen 50 is set adjacent the perforations in casing and is surrounded with a mass of gravel 51. Workstring 52 having a perforated conduit 53 mounted on the lower end thereof is run into and landed on screen 50. Treating fluid is then flowed down the tubing and out through the openings in the conduit 52 to deliver treating fluid directly to the different levels within the screen. The fluid will flow out the screen and through the gravel at the respective levels to treat the different zones in the treatment interval in the same manner as described above.

What is claimed is:

1. Apparatus for treating multiple strata within a treatment interval in a single operation from a single wellbore, said apparatus including:

a workstring comprising a conduit having a perforated section adapted to lie substantially adjacent the interval to be treated; and alternate path means for delivering treatment fluid directly to the respective, different strata of said interval to be treated wherein said alternate path means comprises:

a plurality of shunt tubes, said tube having different lengths and being mounted within said perforated section of said conduit so that their upper ends lie substantially adjacent the upper end of the perforated section and their respective lower ends terminate at different levels within said perforated section.

2. Apparatus for treating multiple strata within a treatment interval in a single operation from a single wellbore, said apparatus including:

a workstring comprising a conduit adapted to extend downward into said wellbore to a point substantially adjacent the top of said interval to be treated; and alternate path means for delivering treatment fluid directly to the respective, different strata of said interval to be treated wherein said alternate path means comprises:

a plurality of tubes having different lengths fluidly connected to the lower end of said conduit whereby the respective lower ends of said tubes are adapted to terminate at different levels adjacent the respective strata to be treated.

* * * * *